United States Patent [19]

Cunningham, Sr.

[11] 4,009,703

[45] Mar. 1, 1977

[54] BOW STRING TRIGGER RELEASE MECHANISM

[76] Inventor: Jerry L. Cunningham, Sr., 5837 Jones St., Wichita, Kans. 67217

[22] Filed: Dec. 17, 1974

[21] Appl. No.: 533,510

[52] U.S. Cl. ..... 124/35 A

[51] Int. Cl.² ..... F41B 5/00

[58] Field of Search ..... 124/35 A, 41 A, 24 R, 124/23 R, 22, 20 B; 272/DIG. 4

[56] References Cited

UNITED STATES PATENTS

| | | | |
|---|---|---|---|
| 2,417,791 | 3/1947 | Tyszkiewicz | 124/35 A |
| 2,637,311 | 5/1953 | Rose | 124/35 A |
| 2,936,749 | 5/1960 | Chellstorp | 124/35 A |
| 2,977,952 | 4/1961 | Gabriel et al. | 124/35 A |
| 3,461,852 | 8/1969 | Brothers | 124/35 A |
| 3,738,651 | 6/1973 | Norman et al. | 272/DIG. 4 X |
| 3,898,974 | 8/1974 | Keck | 124/35 A |

*Primary Examiner*—Richard C. Pinkham
*Assistant Examiner*—William R. Browne
*Attorney, Agent, or Firm*—Phillip A. Rein

[57] ABSTRACT

This invention is a trigger release mechanism usable with a bow and arrow assembly being initially operable 1) to grasp the bow string to pull the same backwards and then 2) to instantaneously and accurately release the bow string through operation thereof. The trigger release mechanism includes a housing assembly; an actuator assembly operably connected to a cam assembly with both mounted within the housing assembly; and an adjustment assembly mounted within the housing assembly. The actuator assembly includes a plunger member operably connected to a main actuator member which, in turn, is operably associated with the cam assembly. Axial movement of the plunger assembly permits rotation of the cam assembly to release the bow string. The adjustment assembly is operable to adjust 1) the resistance to axial movement of the plunger member and 2) amount of axial movement of the plunger member required before release of the bow string through the cam assembly.

9 Claims, 4 Drawing Figures

BOW STRING TRIGGER RELEASE MECHANISM

In one preferred embodiment of this invention, a trigger release mechanism is provided which can be readily held in one's hand and operable to grasp a bow string of a bow member before releasing the same with its interconnected arrow member. The trigger release mechanism includes a housing assembly formed in interconnected half sections; an actuator assembly mounted within the housing assembly; a cam assembly mounted within the housing assembly and operably associated with the actuator assembly; and an adjustment assembly mounted within the housing assembly operably associated with the actuator assembly. The housing assembly is of a irregular shape having a connector section integral with the grip section. The connector section is operable to grasp and be aligned with the bow string. The grip section is provided with a first finger portion on one side of the connector section, a second main grip portion on the opposite side of the connector section, and a thumb portion to receive one's thumb thereagainst. The housing assembly includes a main cavity, a pair of adjustment holes, and a plunger opening. The main cavity is provided with a first cam section integral with an actuator section. The actuator assembly includes a main actuator member pivotally mounted in the housing assembly and having a plunger member pivotally connected to one end thereof. The actuator member is provided at one end with a cam section and at the other end with a plunger section. The plunger member is mounted in the plunger opening and includes a main body having a thumb section extended outwardly of the housing assembly for operation and a lower connector section which is pivotally connected to the plunger section of the actuator member. The cam assembly includes a release cam member pivotally mounted on a main support shaft. The cam member is provided with a string section adapted to contact the bow string and actuator section to engage the cam section of the main actuator member. The adjustment assembly includes an actuator movement adjustment member mounted within one of the adjustment holes and the plunger tension adjustment assembly mounted within the other adjustment hole in the housing assembly. The actuator movement adjustment member is provided with an elongated set screw member having a plunger portion engagable with the main actuator member for adjustment purposes. The plunger tension adjustment assembly includes a compression spring member and a spring set screw being operable to bias the main actuator member to the latched condition thereby adjusting the force needed to permit movement of the release cam member to the unlatched condition.

One object of this invention is to provide a trigger release mechanism which can be readily held in one hand and easily operable through the use of one's thumb to release a bow string being held thereby.

Another object of this invention is to provide a trigger release mechanism including means to grasp a bow string and having an actuator assembly operable through the use of one's thumb to instantaneously release the bow string to achieve the utmost accuracy and consistency.

Another object of this invention is to provide a trigger release mechanism having an adjustment assembly thereon whereupon adjustment can be made in 1) the amount of force necessary to move a plunger member and release the bow string; and 2) the amount of axial movement of the plunger member necessary to obtain release of the bow string.

Another object of this invention is to provide a trigger release mechanism which is held in the latched condition by the bow string and, through operation of a cam assembly connected to an actuator assembly, operation of the actuator assembly operates to permit rotational movement of the cam assembly to release the bow string.

One other object of this invention is to provide a trigger release mechanism being of an irregular contoured shape which can be comfortably held in one's hand in a firm manner and having a place to rest and steady one's thumb before lateral movement of a plunger member to release a bow string.

Still, one further object of this invention is to provide a trigger release mechanism which is sturdy in construction, reliable in operation, readily adjusted to fit one's shooting requirements, easy to aim and operate, and reliable in consistency of results.

Various other objects, advantages, and features of the invention will become apparent to those skilled in the art from the following discussion, taken in conjunction with the accompanying drawings, in which.

Figure 1:
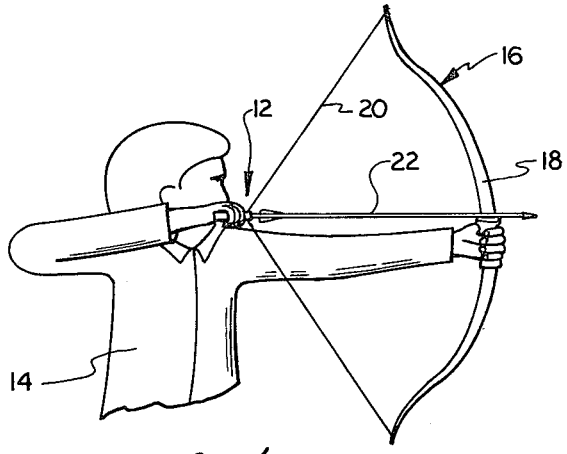
FIG. 1 is a perspective view of a trigger release mechanism of this invention illustrated as being utilized by a person and attached to a bow string of a bow and arrow assembly.

The following is a discussion and description of preferred specific embodiments of the new trigger release mechanism of this invention, such being made with reference to the drawings, whereupon the same reference numerals are used to indicate the same or similar structure. It is to be understood that such discussion and description is not to unduly limit the scope of the invention.

In referring to FIG. 1 of this invention, a trigger release mechanism, indicated generally at 12, is shown as being held in the right hand of an individual indicated at 14 who is utilizing a bow assembly 16 having a bow member 18, interconnected bow string 20, and an arrow member 22. The trigger release mechanism 12 is operable to grasp a central portion of the bow string 20 adjacent the arrow member 22 for proper aiming and holding prior to release.

Figure 2:
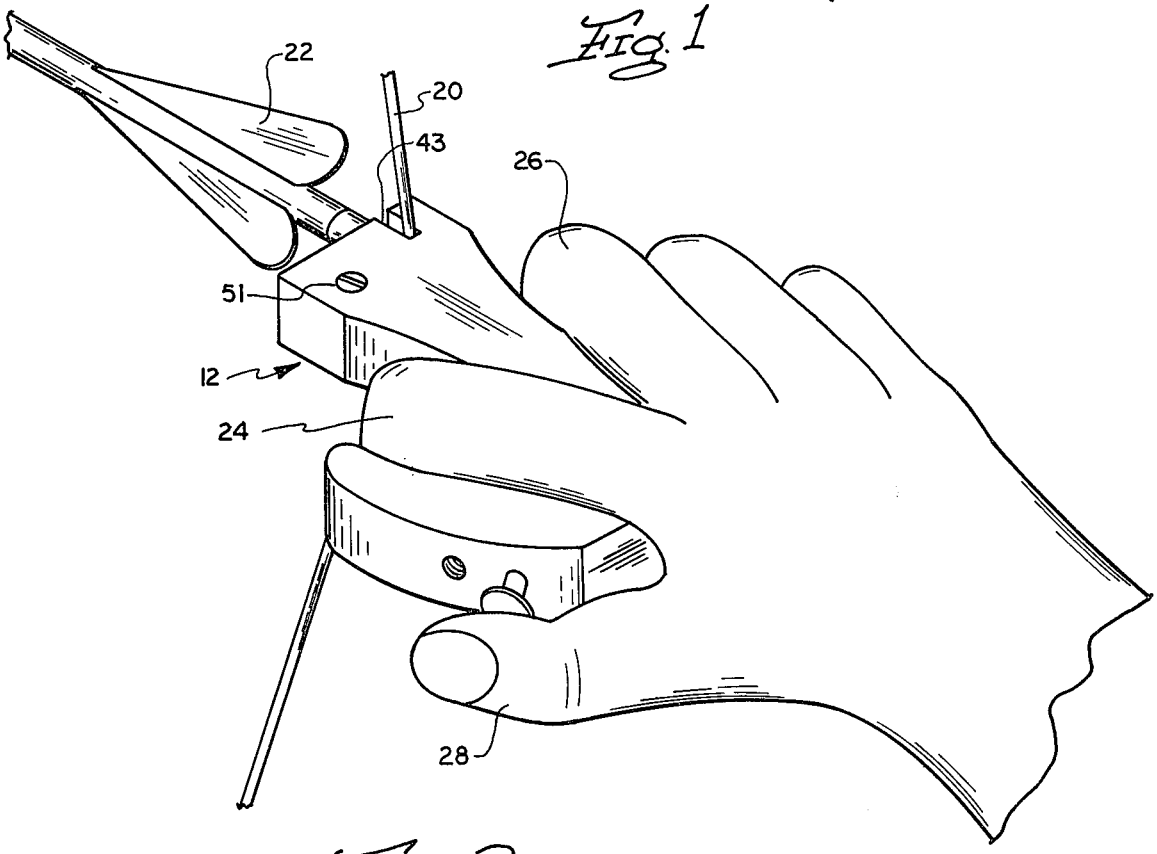
FIG. 2 is an enlarged view of the trigger release mechanism of this invention illustrating how one's hand grasps the same.
Figure 3:
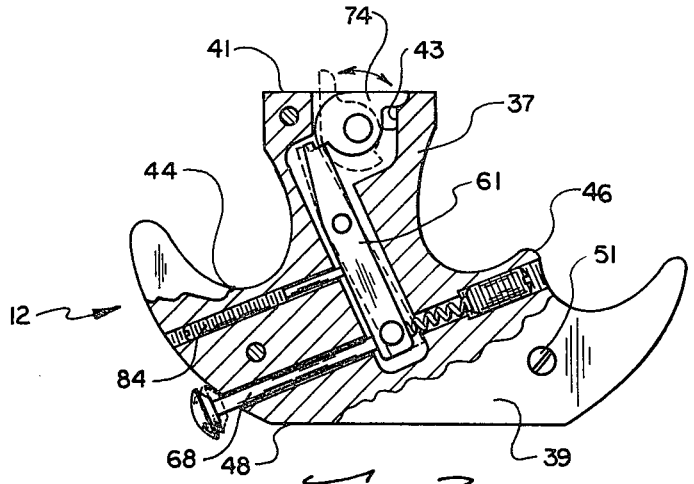
FIG. 3 is a top plan view of the trigger release mechanism of this invention having portions broken away for clarity.

As shown in FIG. 2, the trigger release mechanism 12 may be grasped between the first and second fingers 24, 26 of the right or left hand and having a portion to receive the thumb member 28 thereagainst as will be explained.

The trigger release mechanism 12 includes a main housing assembly 30; a cam assembly 32 pivotally mounted within the housing assembly 30 and operably associated to an actuator assembly 34; and an adjustment assembly 36 mounted within the housing assembly 30 adaptable to contact the actuator assembly 34 for proper adjustment. The housing assembly 30 is of an irregular shape having a main connector section 37 and an integral grip section 39. The connector section 37 includes a flat forward face 41 and has an opening 43 therein adapted to receive the bow string 20 for grasping purposes. The grip section 39 includes a first finger portion 44 and a second main grip portion 46. One's first finger is adapted to fit comfortably within the first finger portion 44 as shown in FIG. 2 with the remaining three fingers to be placed within the contour of the grip portion 46. The rear wall of the grip section 39 is provided with a flat surface 48 adapted to receive the portion of one's thumb thereon. The housing assembly 30 is preferrably constructed in two half sections and interconnected as by screw members 51 with each half section having a main cavity 52, adjustment holes 54, and a plunger opening 56. The main cavity 52 includes a cam section area 57 integral with an enlarged actuator section area 59. The adjustment holes 54 are provided with threads therein to receive portions of the adjustment assembly 36 as will be explained.

The actuator assembly 34 includes a main actuator member 61 pivotally connected by a shaft member 63 to the housing assembly 30 and having one end connected to a plunger member 64. The main actuator member 61 includes a central support section 65 connected to the shaft member 63 and outwardly thereof at one end a cam section 66 and at the opposite end a plunger section 67. The length of the cam section 66 and the plunger section 67 to the pivotal connection at the central support section 65 is predetermined to achieve the proper movement of the cam section 66 on relative movement of the plunger section 67.

The plunger member 64 includes a main body 68 having an upper thumb section 69 and a lower connector section 71 pivotally connected through a support shaft 73 to the plunger section 67 of the main actuator member 61. The main body 68 is of a diameter to snugly fit within the plunger opening 56 for precise axial movment as will be explained. The thumb section 69 resembles a curved cap structure to comfortably receive one's thumb thereon.

The cam assembly 32 includes a main release cam member 74 pivotally mounted on a support rod 76 mounted within the support housing assembly 30. The release cam member 74 includes a string section 77 and an actuator section 79. The string section 77 resembles a finger member and, when in the bow string holding position, has a retaining face 81 extended perpendicular to the bow string 20. The actuator section 79 is provided with a stepped portion 83 to engage the cam section 66 of the main actuator member 61 as shown in FIG. 4 when in the hold condition.

The adjustment assembly 36 includes an actuator movement adjustment member 84 and a plunger tension adjustment assembly 86 both of which are operably engagable with the main actuator member 61. The actuator movement adjustment member 84 includes a set screw member 88 readily mounted within one of the adjustment holes 54 and having a plunger portion 90 on the outer end thereof. As shown in FIG. 4, the plunger portion 90 is adapted to engage an outer surface 92 of the actuator member 61 to regulate the amount of pivotal movement of the actuator member 61 necessary to cause operation of the release cam member 74 as will be explained.

The plunger tension adjustment assembly 86 includes a spring member 94 and a set screw member 96 mounted within the other one of the adjustment holes 54. The spring member 94 is engagable with the plunger section 67 of the main actuator member 61. The spring set screw member 96 is axially adjusted within the adjustment hole 54 to regulate the compression force of the spring member 94 against the plunger section 67 for reasons to be explained.

Figure 4:
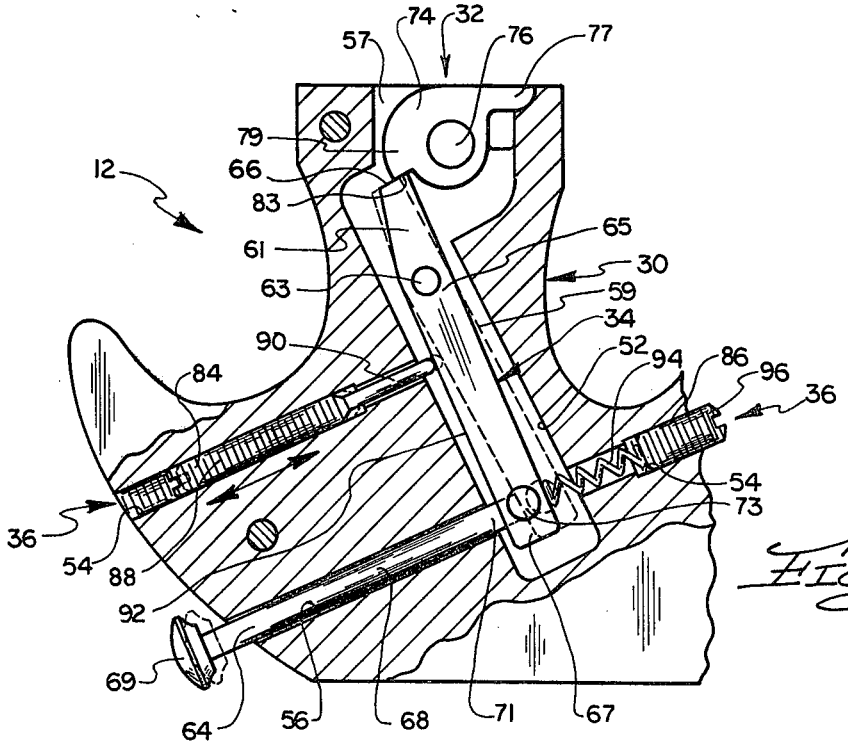
FIG. 4 is an enlarged fragmentary top plan view having portions broken away for clarity.

In the use and operation of the trigger release mechanism 12 of this invention starting with the hold condition of FIG. 4, the release cam member 74 is pivoted as far as possible in a clockwise direction and the cam section 66 of the main actuator member 61 is engagable with the actuator section 79 of the release cam member 74. The bow string 20 is operable to be placed within the opening 43 between the string section 77 of the release cam member 74 and the housing assembly 30. On pulling back the bow string 20, it is obvious that the bow string 20 would tend to rotate the release cam member 74 in a counter-clockwise direction as shown in FIG. 4. Movement of the release cam member 74 is restricted by the contacting faces of the actuator section 79 of the release cam member 74 and the cam section 66 of the main actuator member 61.

In this condition as shown in FIG. 4, it is seen on downward movement of the plunger member 64 (shown in dotted lines) causes pivotal movement of the actuator member 61 to the position shown in dotted lines. At a certain point in such movement, the cam section 66 of the main actuator member 61 and the actuator section 79 of the release cam member 74 are no longer in contact and, the force of the bow string 20 thereupon forces rotation of the release cam member 74 in a counterclockwise direction as viewed in FIG. 4. This, of course, then allows the bow string 20 to be released with the accompanying arrow member 22.

It is noted that the area of contact between the cam section 66 of the main actuator member 61 and the actuator section 79 of the release cam member 74 can be varied on adjustment of the actuator movement adjustment member 84. Therefore, it is seen that the set screw member 88 can be moved downwardly thereby reducing the area of contact of the cam section 66 and the actuator section 79 requiring less movement of the plunger member 64 before movement of the release cam member 74 to release the bow string 20.

Additionally, the movement of the plunger member 64 against the force of the compression spring member 94 of the plunger tension adjustment assembly 86 can be regulated to adjust resistance to movement of the plunger member 64. This is important whether utilizing the trigger release mechanism 12 for hunting purposes, target shooting, or variations in the release force required between men and women shooters.

It is obvious that the trigger release mechanism can be readily used by right or left hand bow shooters by rotating 180° from horizontal position shown in FIG. 2.

It is seen that the trigger release mechanism of this invention provides a structure that is easily held in one's hand and is positioned at the point of aiming a bow and arrow combination. The adjustment assembly of the trigger release mechanism is operable to readily adjust the amount of plunger movement and the force resisting such movement so that the trigger release mechanism is readily adjustable to meet the requirements of all types of shooters. Additionally, the trigger release mechanism is provided with an outer contoured configuration to fit one's hand in a most comfortable manner.

The actuation of the trigger release mechanism is through a horizontal lateral movement of one's thumb instead of a forward or rearward movement resulting in a balancing of forces to increase accuracy. This balancing of forces is extremely important in obtaining the accuracy of arrow release which is important in all types of shooting.

The trigger release mechanism of this invention is an attractive appearing structure which is economical to manufacture, sturdy in construction, reliable in operation, completely adjustable to fit one's bow shooting requirements, and, through testing, has proved to be an extremely accurate and consistant release mechanism.

While the invention has been described in conjunction with preferred specific embodiments thereof, it will be understood that this description is intended to illustrate and not to limit the scope of the invention, which is defined by the following claims.

I claim:

1. A trigger release mechanism adapted to first grasp a bow string of a bow and arrow assembly and secondly release the bow string, comprising:

a. a housing assembly having an outer contour to be grasped by one's hand.

b. an actuator assembly mounted in said housing assembly;

c. said actuator assembly having an actuator member pivotally connected and a plunger pivotally connected to said actuator member and with inward pressure thereon causing pivoting of one end of said actuator member;

d. a cam assembly having a release cam member mounted in said housing assembly and releasably engagable with the other end of said actuator member;

e. said actuator member having a first pivoted position wherein the actuator member engages and holds said cam member against rotation while holding an entrapped bow string within the housing during a drawing operation of a bow string; and f. said actuator member having a second position wherein said actuator member is out of contact with said release cam member to permit said cam member to pivot and release a bow string.

2. A trigger release mechanism as described in claim 1, wherein:

a. said plunger member being movable longitudinally along its longitudinal axis within a plunger opening in said housing assembly to move said actuator member from the first to the second positions.

3. A trigger release mechanism as described in claim 1, wherein:

a. said other end of said actuator member having a section engagable with said release cam member; and b. said release cam member pivotally mounted in said housing assembly and having a string holding section which contacts a bow string and an actuator section operable to contact said cam engaging section of said actuator member.

4. A trigger release mechanism as described in claim 3, including:

a. an actuator movement adjustment member mounted in said housing assembly having a portion in a position to contact said actuator member; and b. said actuator movement adjustment member being adjustably movable in said housing assembly to vary the amount of movement of said plunger member necessary to move said cam engaging section out of contact with said release cam member.

5. A trigger release mechanism as described in claim 3, including:

a. a plunger tension adjustment assembly mounted in said housing assembly and in contact with said one end of said actuator assembly; and b. said plunger tension adjustment assembly resiliently resists movement of said plunger member from said first position to said second position to vary the force needed to pivot said actuator member about its pivot axis.

6. A trigger release mechanism as described in claim 5, wherein:

a. said plunger tension adjustment assembly having a spring biasing member contacting said actuator member and having an axially movable set screw threadably mounted in said housing assembly to engage said spring biasing member; and b. said set screw being movable axially to adjust biasing force of said spring biasing member against said actuator member to vary the force needed to act on said plunger member to cause said actuator member to pivot out of engagement with said release cam member.

7. A trigger release mechanism as described in claim 1, wherein:

a. said housing assembly of an irregular contour having a first finger section and a main grip section to receive one's fingers therein, and a thumb section adjacent said plunger member; and b. said actuator member mounted in said housing assembly between said first finger section, said main grip section, and said thumb section, whereby one's thumb may rest on said thumb section and contact said plunger member simultaneously for steady operation and release of a bow string and one's hand completely surrounding said actuator member for balanced release reaction forces.

8. A trigger release mechanism as described in claim 1, wherein:

a. said plunger member is pivotally connected to said one end of said actuator member;

b. said release cam member being pivotally connected to said housing assembly; and c. the axis of said pivotal connections of said release cam member, said plunger member and said actuator members extending substantially parallel to each other.

9. A trigger release mechanism as described in claim 1, wherein:

a. said plunger member, said release cam member, and said actuator member being positioned substantially in a common plane.

* * * * *